United States Patent [19]

Troncoso, Jr.

[11] 4,332,232

[45] Jun. 1, 1982

[54] ARCHERY BOW WITH SPRING-BIASED ARROW REST

[76] Inventor: Fernando Troncoso, Jr., 1851 S. Orange Ave., Monterey Park, Calif. 91754

[21] Appl. No.: 194,824

[22] Filed: Oct. 7, 1980

[51] Int. Cl.[3] ..... F41B 5/00

[52] U.S. Cl. ..... 124/24 R; 124/41 A

[58] Field of Search ..... 124/41 A, 24 R, 88

[56] References Cited

U.S. PATENT DOCUMENTS 3,890,951 6/1975 Jennings et al. ..... 124/41 A

OTHER PUBLICATIONS

"Match-1" -Archery Magazine, May 1974, p. 45.

*Primary Examiner*—Richard C. Pinkham
*Assistant Examiner*—William R. Browne
*Attorney, Agent, or Firm*—Donald E. Nist

[57] ABSTRACT

The improved assembly comprises, in combination, an archery bow with arrow shelf and sidewalls defining an arrow window, an archery arrow and an improved arrow rest disposed in the window and supporting the arrow in the window for shooting from the bow. The rest is particularly adapted for hunting in that it locks the arrow in place, preventing it from rolling off the rest or inadvertently dropping through the rest and down onto the shelf before shooting. The rest includes a holder comprising a canted hook, the forward end of which contacts the bottom and outer margins of the arrow shaft. The inner margin of the hook is spaced less than the width of the arrow shaft from the sidewall. The holder is biased by a spring into the holding position. A side support such as a plunger resiliently biases the arrow away from the sidewall. A connector bracket adjustably positions the holder relative to the arrow. The connector includes a rear arm bearing the holder and is rotatable against the spring. When the arrow is strung on the bow, it can be placed in the locked carrying position by pushing the front end of the arrow down to trap the arrow shaft between the underside of the side support, the sidewall and the holder. The arrow can be easily moved to the shooting position, when needed. The assembly is highly effective, affords positive arrow vane clearance and is simple, durable and inexpensive.

6 Claims, 4 Drawing Figures

ARCHERY BOW WITH SPRING-BIASED ARROW REST

BACKGROUND OF THE INVENTION

1. Field of the Invention

The present invention generally relates to sports equipment and more particularly to an archery bow assembly which is especially adapted for hunting, permitting free unimpeded arrow flight but also permitting the arrow to be locked in place on the bow.

2. Prior Art

The usual type of arrow rest is a fixed horizontal ledge attached to the bow sidewall and jutting out into the window above the handle and arrow shelf. The rest may be fabricated of feathers, of leather, plastic or the like and is adapted to support an arrow in the window from below. It presents a potential problem to the archer in that the arrow feathers or vanes, and even the shaft in some instances, may strike the rest as the arrow moves forward immediately after bowstring release. Such striking slows the arrow, wears and eventually damages the vanes and rest, causes arrow wobble and reduces shooting accuracy. As the vanes or feathers wear, they also cause the arrow to change its point of impact and reduce accuracy. This is particularly critical in hunting where the hunter may only have a few real opportunities over a several-day period to make a kill. Each arrow released must be accurate.

Striking of the rest may be avoided if the rest is made narrow enough and if the arrow shaft flexes or bends laterally enough upon release of the bowstring, thus following a pronounced S-curve, as may be the case when the fingers or a finger tab or glove are used in drawing and releasing the bowstring. However, when a mechanical bowstring release is used to draw and release the bowstring, such lateral flexing is diminished very noticeably. This is even more the case when a compound archery bow is shot with a mechanical bowstring release. Moreover, a narrow rest increases the likelihood of the arrow rolling off the rest during hunting before release of bowstring, thus causing a wild shot. In contrast, "pass through" rests have a wide gap between the arrow shaft and sidewall but also are prone to inadvertant fall through between the rest and sidewall before bowstring release, especially during the excitement of the hunt.

Certain arrow rests employ a hinged wire component which is held magnetically in an arrow-supporting position and bridges the gap to the sidewall but which swings forward and closes when struck by the arrow vane or feather. If such a wire is joggled, it can prematurely close, dropping the arrow to the shelf. While such rests reduce arrow wear and deflection, those effects are still noticeably present. Archery shooting requires extreme accuracy to hit distant mobile game. Therefore, it would be highly desirable to be able to provide an improved archery assembly which could assure complete clearance of the arrow shaft and vanes upon shooting the arrow from the bow and also positive holding of the arrow to prevent its inadvertant roll off or fall through the rest. Such assembly should be relatively inexpensive and durable and be particularly adapted for use in bowhunting.

Various types of arrow locks have been added to bows to allow the arrow to be carried on the bow during hunting without danger of it falling off. However, such devices are clumsy, expensive, take valuable room and in some instances are complicated to use. It would be desirable to accomplish the same purposes with a simpler mechanism.

SUMMARY OF THE INVENTION

The improved archery bow assembly of the present invention satisfies all the foregoing needs. The assembly is substantially as set forth in the Abstract above. Thus, it includes an archery bow with arrow window, an arrow and a rest holding the arrow in the window in such a manner that the arrow can be positively locked in place to prevent it from rolling off the bow. The rest also allows the arrow to be shot through the bow in an unimpeded flight without striking the rest, side support, bow sidewall or shelf.

The rest features a supporting holder in the form of a canted hook contacting the bottom and outer margins of the arrow shaft and biasing it toward a depressible side support, which preferably is a plunger of plastic or the like. The inner margin of the hook is spaced from the bow sidewall a distance less than the width of the arrow, so that the arrow shaft can be locked in place for carrying merely by pushing it down below the side support and sliding it into contact with the sidewall so that it is trapped between the underside of the side support and the holder. The holder is spring biased to hold the shaft in place and also to swing down out of the way as the arrow is shot from the bow from the normal shooting position. A connector bracket secured to the bow in the area of the window supports the rear end of the holder and is adjustable regarding the biasing force and position of the holder. The rest is durable, rugged, inexpensive, simple to use and highly efficient. It is particularly suitable for bowhunting. Further features are set forth in the following detailed description and accompanying drawings.

DRAWINGS

DETAILED DESCRIPTION

FIGS. 1–4

Figure 1:
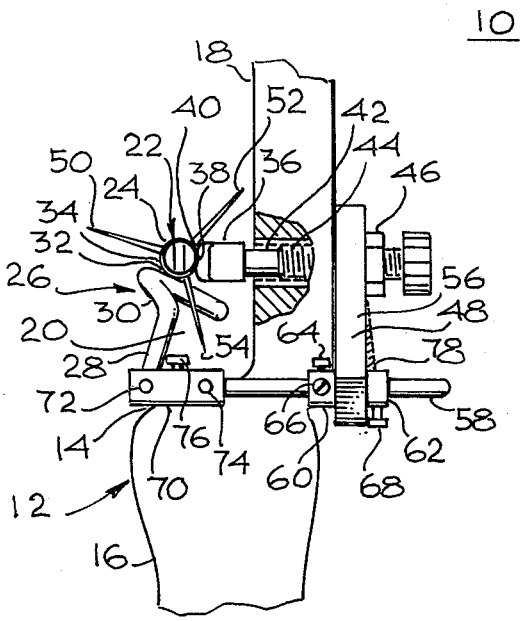
FIG. 1 is a fragmentary schematic rear elevation, partly broken away, of a first preferred embodiment of the improved archery bow assembly of the present invention with the arrow in the shooting position.
Figure 2:
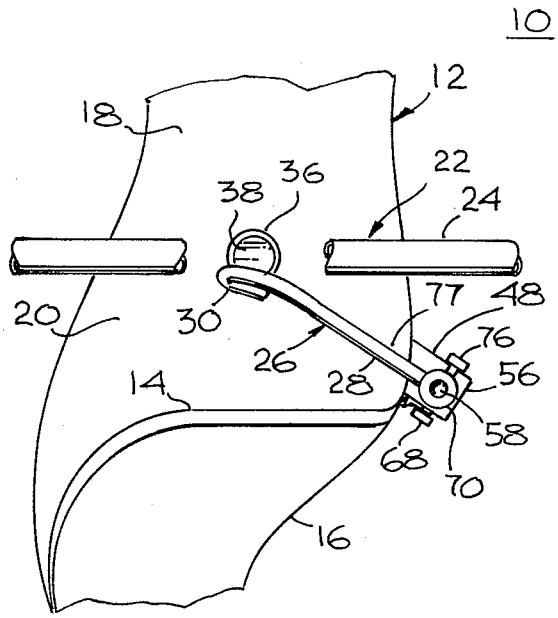
FIG. 2 is a fragmentary schematic side elevation, partly broken away, of the arrow window side of the assembly of FIG. 1.

A preferred embodiment of the improved archery bow assembly of the present invention is schematically depicted in FIGS. 1–4. Thus, assembly 10 is shown which includes an archery bow 12 of the longbow or recurve type or the like having a shelf 14 above a handle 16 and a sidewall 18, the shelf 14 and sidewall 18 defining a window 20 within which an arrow 22 is supported by its shaft 24 for shooting from bow 12 (FIG. 1). An arrow rest 26 supports the arrow 22 in window 20 and comprises a holder 28 in the form of a canted curved hook 30. The inner margin of the head of hook 30 is spaced from sidewall 18 slightly less than the diameter of shaft 24 so that shaft 24 cannot fall to shelf 14 when placed in the locked position shown in FIG. 4.

The bottom 32 and outer lateral margins 34 of shaft 24 are supported by hook 30 in the normal shooting position, hook 30 biasing shaft 24 against a spring biased depressible plunger 36 extending horizontally into window 20 through sidewall 18. Plunger 36 includes a plastic coated head 38 contacting the inner lateral margin 40 of shaft 24. Head 38 is connected to shaft 42 extending through cylinder 44 in sidewall 18. The lateral position of head 38 is adjustable, as by set nut 46 threaded on cylinder 44 and contacting a bracket 48 in order to provide proper clearance of arrow vanes 50, 52 and 54 during shooting of arrow 22. Cylinder 4 extends through bracket 48 and nut 46 holds bracket 48 against sidewall 18 on the side thereof away from window 20, as shown in FIG. 1.

Bracket 48 comprises a first arm 56 extending longitudinally rearwardly of base 12 and a second rear transverse arm 58 rotatably and adjustably secured to arm 56, as by collars 60 and 62 with set screws 64, 66 and 68. Arm 58 projects to the rear of window 20 and includes a clamp 70 bearing channels 72 and 74 and secured by a set screw 76. The rear end 77 of hook 30 slopes down and is adjustably releasably held in clamp 70. Hook 30 can be moved forward and rearward and also can be angled diagonally in clamp 70 towards or away from sidewall 18. It can also be moved laterally by repositioning arm 58 in arm 56. Thus, complete adjustability is provided to accommodate most arrows and fletchings.

Figure 3:
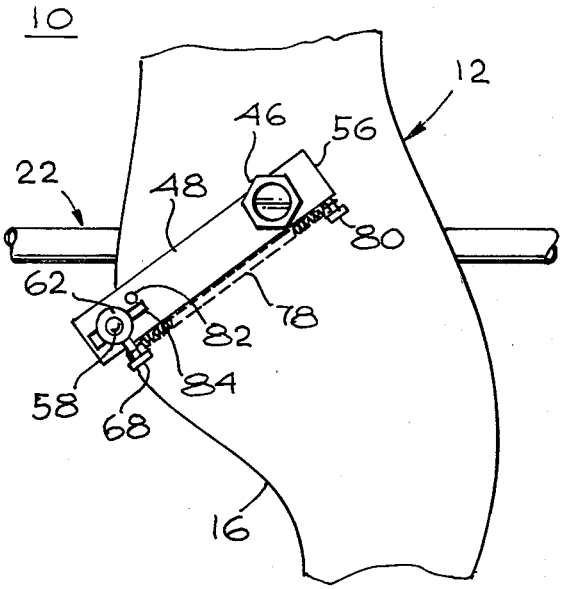
FIG. 3 is a fragmentary schematic side elevation, partly broken away, of the opposite side of the assembly of FIG. 1.

A spring 78 is disposed between and connected to screw 68 of arm 58 and set screw 80 at the front end of arm 56 (FIG. 3). Spring 78 biases the front end of hook 30 up towards shaft 24. A pin 82 protruding transversely from arm 56 adjacent arm 58 and a set screw 84 on collar 62 attached to arm 58 act as adjustable limit means to control the uppermost position of the front end of hook 30. The biasing effect of spring 78 can be adjusted, as by stretching or lengthening spring 78 or substituting a weaker or stronger spring, etc.

Figure 4:
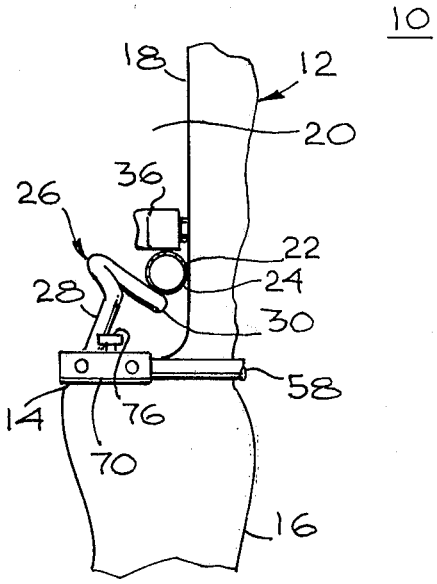
FIG. 4 is a fragmentary schematic rear elevation, partly broken away, of the assembly of FIG. 1, with the arrow in the locked position.

When arrow 22 is strung on bow 12 and shaft 24 is placed on the front end of hook 30, it is biased against head 38 and will not readily roll off or fall between hook 30 and head 38 because hook 30 fully supports it in the shooting position shown in FIG. 1. The front end of shaft 24 can be pushed down against spring biased hook 30 and then slid laterally until shaft 24 is trapped between head 38, hook 30 and sidewall 18 and thus held rigidly in the position shown in FIG. 4. In this position it is locked to the bow for carrying during hunting and cannot be dislodged. When arrow 22, carried in the locked position of FIG. 4 is to be shot, shaft 24 is pushed down against hook 30 and slid laterally to free it from head 38, then hook 30 is allowed to rise, placing shaft 24 in the shooting position of FIG. 1. When the bowstring (not shown) is then drawn and shot, at release the downward force exerted by the arrow shoves the front end of hook 30 down against the biasing effect of spring 78 and arm 58 rotates in arm 56, thus clearing window 20 so that vanes 50, 52 and 54 and shaft 24 will not strike head 38, sidewall 18, shelf 14 or rest 26, thus providing unimpeded accurate, wobble-free arrow flight for improved accuracy.

Adjustments can be made in the position of head 38 and hook 30 to assure maximum arrow clearance and proper locking. Fine tuning of the bow by movement of the string's nock position will further assure the best arrow flight. A bowhunter can use the described assembly 10 with assurance of fewer missed shots and greater accuracy and safety. The components of assembly 10 can be of conventional materials and are easily and inexpensively assembled. Moreover, they are durable and simple to adjust.

Various modifications, changes, alternations and additions can be made in the improved archery bow assembly of the present invention, its components and their parameters. All such modifications, changes, alterations and additions as are within the scope of the appended claims form part of the present application.

What is claimed is:

1. An improved archery bow assembly, particularly adapted for hunting, said assembly comprising in combination:

a. an archery bow having an arrow shelf and sidewall defining an arrow window;

b. an archery arrow having an arrow shaft; and, c. an improved arrow rest disposed in said window and supporting said arrow in said window for shooting from said bow, said rest including i. arrow spring biasing means secured to said bow, ii. a holder comprising a hook the forward end of which contacts the bottom and outer margins of the shaft of said arrow, the inner margin of said forward end of said hook being spaced from said sidewall a distance less than the diameter of said shaft, said holder being biased by said spring biasing means into an arrow supporting position, to prevent inadvertant roll off or drop through of said arrow from said rest before shooting thereof, iii. a side support secured to the sidewall of said bow, contacting the inner margin of said shaft and resiliently biasing said arrow in said window away from said sidewall, for improved arrow vane clearance, and, iiii. a connector means adjustably positioning said holder in said window and connecting said holder to said bow, said arrow being releasably locked by said connector means to said bow by being trapped and held in place by said holder, said sidewall and the underside of said side support, and said shaft being spring biased by said hook's forward end upwardly against the underside of said side support.

2. The improved archery assembly of claim 1 wherein said connector includes a bracket extending from the side of said bow around the rear end thereof, and includes a first longitudinally extending arm and a second arm transverse of said bow and releasably, adjustably rotatably secured to said first arm and capable of adjusting the angle and spacing of said holder relative to said arrow, the rear end of said holder being attached to said second arm.

3. The improved archery assembly of claim 2 wherein said holder is adjustable laterally, up and down and in an arc towards and away from said sidewall, all by means of said connector means.

4. The improved archery assembly of claim 1 wherein the front end of said hook is curved and tilted downwardly to facilitate arrow clearance.

5. The improved archery assembly of claim 1 wherein said holder is slanted toward said side support.

6. An improved archery bow assembly, particularly adapted for hunting, said assembly comprising in combination:

a. an archery bow having an arrow shelf and sidewall defining an arrow window;

b. an archery arrow having an arrow shaft; and, c. an improved arrow rest disposed in said window and supporting said arrow in said window for shooting from said bow, said rest including i. arrow spring biasing means secured to said bow, ii. a holder comprising a hook the forward end of which contacts the bottom and outer margins of the shaft of said arrow, the inner margin of said forward end of said hook being spaced from said sidewall a distance less than the diameter of said shaft, said holder being biased by said spring biasing means into an arrow supporting position, to prevent inadvertant roll off or drop through of said arrow from said rest before shooting thereof, iii. a side support secured to the sidewall of said bow, contacting the inner margin of said shaft and resiliently biasing said arrow in said window away from said sidewall, for improved arrow vane clearance, and, iiii. a connector means adjustably positioning said holder in said window and connecting said holder to said bow, said arrow being releasably locked by said connector means to said bow by being trapped and held in place by said holder, said sidewall and the underside of said side support, said connector including a bracket extending from the side of said bow around the rear end thereof, and including a first longitudinally extending arm and a second arm transverse of said bow and releasably, adjustably rotatably secured to said first arm and capable of adjusting the angle and spacing of said holder relative to said arrow, the rear end of said holder being attached to said second arm, said spring biasing means comprisng a coil spring extending between said first and second arms and said first and second arms bearing rotational limit means.

* * * * *